US006183158B1

(12) United States Patent
Lynton

(10) Patent No.: US 6,183,158 B1
(45) **Date of Patent: *Feb. 6, 2001**

(54) PROTECTIVE COVER

(75) Inventor: Jeanette R. Lynton, Pleasant Grove, UT (US)

(73) Assignee: Cabin Creek, Ltd., Pleasant Grove, UT (US)

( * ) Notice: Under 35 U.S.C. 154(b), the term of this patent shall be extended for 0 days.

This patent is subject to a terminal disclaimer.

(21) Appl. No.: 09/493,505

(22) Filed: Jan. 28, 2000

Related U.S. Application Data

(63) Continuation of application No. 09/036,369, filed on Mar. 6, 1998, now Pat. No. 6,019,539.

(51) Int. Cl.[7] ..... B42F 13/00

(52) U.S. Cl. ..... 402/79; 206/450; 206/455; 281/15.1; 281/21.1; 281/22; 281/31; 281/38

(58) Field of Search ..... 206/450, 455; 281/15.1, 21.1, 28, 22, 31, 38, 40; 402/79

(56) References Cited

U.S. PATENT DOCUMENTS

| | | | | |
|---|---|---|---|---|
| D. 325,817 | | 5/1992 | Call | D3/35 |
| 3,043,737 | * | 7/1962 | Engelstein | 156/196 |
| 3,651,591 | | 3/1972 | Woodyard | 40/104.19 |
| 3,735,516 | * | 5/1973 | Wenstrom | 40/104.18 |
| 4,516,871 | | 5/1985 | Leitman | 402/79 |
| 4,629,070 | * | 12/1986 | Roberg | 206/455 |
| 4,787,766 | * | 11/1988 | Lorsch | 402/79 |
| 5,265,359 | | 11/1993 | Glazer et al. | 40/159 |
| 5,314,066 | * | 5/1994 | Gresh | 206/389 |
| 5,316,404 | | 5/1994 | Hensel | 402/79 |
| 5,335,027 | * | 8/1994 | Lin et al. | 353/120 |
| 5,436,694 | * | 7/1995 | Ishikawa et al. | 355/75 |

(List continued on next page.)

OTHER PUBLICATIONS

Rembrandt Photo Services drawing no. P2133AK, dated 11/11/93.
Rembrandt Photo Services drawing no P2135AK, dated 11/11/93.
Rembrandt Ultra PRO catalog extracts dated 1993 (3 pages).
Rembrandt Ultra PRO catalog extracts dated 1996–1997 (3 pages).
Rembrandt Horizontal Photo Albums and Pages flyer dated 1993, 1994 (1 page).
20$^{th}$ Century Plastics catalog extracts dated Jan. 1991 (2 pages).

*Primary Examiner*—A. L. Wellington
*Assistant Examiner*—Monica S. Carter
(74) *Attorney, Agent, or Firm*—Kirton & McConkie; Dale E. Hulse; Berne S. Broadbent

(57) ABSTRACT

A flexible sheet protector is disclosed in one presently preferred embodiment as including first and second transparent sheets having at least one receiving pocket formed therebetween. Formed in spaced-apart relation to the retaining pocket of the flexible sheet protector is a securement portion comprising at least one through-bore having an internal periphery being dimensionally sufficient for engaging one or more retaining members of a loose-leaf binder. Operably disposed between the retaining pocket and the securement portion of the flexible sheet protector is a flexible pocket. Structurally, the flexible pocket preferably comprises an elongated body having at least two opposing sealed sides, an opening formed adjacent an opening of the receiving pocket, and a sealed end disposed contiguous the closed end of the flexible sheet protector. The structural disposition of the flexible pocket in relation to the receiving pocket and the securement portion provides a means for flexing or bending the sheet protector along the dimensional length of the elongated body of the flexible pocket, rather than inadvertently bending the contents of the retaining pocket upon manipulation of the sheet protector.

20 Claims, 3 Drawing Sheets

U.S. PATENT DOCUMENTS

| | | | |
|---|---|---|---|
| 5,462,160 | 10/1995 | Youngs | 206/312 |
| 5,480,192 | 1/1996 | Angerbauer et al. | 281/31 |
| 5,558,454 | 9/1996 | Owen | 402/79 |
| 5,597,256 | 1/1997 | Burton et al. | 402/4 |
| 5,788,075 | 8/1998 | Wrabel | 206/455 |
| 5,795,089 | 8/1998 | Ong | 402/79 |
| 5,801,852 * | 9/1998 | Truc et al. | 358/502 |
| 6,019,539 * | 2/2000 | Lynton | 402/79 |

* cited by examiner

PROTECTIVE COVER

RELATED APPLICATIONS

This application is a continuation of U.S. patent application Ser. No. 09/036,369, filed Mar. 6, 1998, now U.S. Pat. No. 6,019,539 entitled "FLEXIBLE SHEET PROTECTOR", the priority of which is claimed under 35 U.S.C. § 120, which application is incorporated by reference herein.

FIELD OF THE INVENTION

This invention relates to accessories for insertion and retention in loose-leaf binders and, more particularly, to a novel flexible sheet protector selectively disposed in relation to one or more retaining members of a loose-leaf binder or scrapbook which comprises a flexible pocket formed therein to provide a means for flexing along the dimensional length of the pocket rather than inadvertently bending the contents of the sheet protector.

BACKGROUND

Traditionally, loose-leaf binders of the prior art are typically comprised of a binding having a back member or spine attached between a front panel and a rear panel. A principle component of prior art loose-leaf binders is one or more selectively openable retaining members such as, for example, D-rings, spreadable tabs, extendable posts, rods, or the like. In typical design, prior art retaining members are generally distributed along the linear length of the binder contiguous with the back member or spine.

Retaining members of the prior art may be secured to a clamping mechanism that is attached by some suitable fastener to the back member or spine of the binder. In the alternative, a row or series of posts or rods may extend substantially outward from the rear panel of a binder in such a manner so as to selectively engage corresponding capping sleeves extending substantially outward from the front panel, thus providing a means for binding both the front and rear panels of the binder. As readily appreciated by those skilled in the art, various configurations, shapes, and/or attachment schemes, as well as attachment locations of prior art retaining members, exist in the art for loose-leaf binders.

In operation, each retaining member usually engages one or more openings formed in a leaf of paper or a protective sheet which may be selectively introduced into and retained by prior art loose-leaf binders. Typically, prior art loose-leaf binders are formed having two, three, five, seven, or sometimes dozens of retaining members operably disposed in relation to the back member or spine of the binder which provide a means for engaging a plurality of selectively insertable leafs or protective sheets. Because of the various retaining member configurations and the standardization of sizes and placement of retaining members as is appreciated in the art, prior art loose-leaf binders are sometimes referred to by the capacity of insertable leafs or sheets and, more specifically, by the standard number or configuration of retaining members that are operably disposed in relation therewith. For example, those in the art may make reference to "D-ring" binders, "three-ring" binders, "three-inch, three-ring" binders, "two-post, lay-flat" binders, and/or "two-inch, three-ring, D-ring" binders, and so forth.

Because of the numerous types, sizes, and configurations of prior art loose-leaf binders, those skilled in the art developed insertable leafs and protective sheets comprising engagement openings which conform to one or more of the multiplicity of retaining member configurations readily known in the art. Correspondingly, the size and dimension of insertable paper leafs and/or protective sheets generally vary depending upon their market application. For example, the dimensional size of an eight and one-half inches by eleven inches (8½"×11") sheet has become a standard size for prior art insertable leafs and/or protective sheets manufactured in the industry and, accordingly, loose-leaf binders of the prior art are often described by the size of the insertable leaf or protective sheet introduced and selectively retained therein. Other insertable leaf or protective sheet sizes that are manufactured by those in the industry may include, for example, three and three-fourth inches by six and three-fourth inches (3¾"×6¾"), five and one-half inches by eight and one-half inches (5½"×8½"), legal size (8½"×14"), and so forth. Moreover, protective sheets of the prior art are typically formed having a size which is slightly larger in dimension than standardized paper sizes so as to provide a means for housing one or more leafs of paper, paperboard, or the like which may comprise pictures and/or other memorabilia mounted thereon.

In an effort to provide protective sheets for loose-leaf binders comprising a means for protecting mounted pictures and/or other memorabilia disposed in relation thereto, those skilled in the art developed prior art sheet protectors formed of an upper and lower layer of substantially transparent plastic material so as to permit viewing of a leaf or sheet of paper, paperboard, or the like which may be selectively disposed within a receiving pocket defined between the upper and lower layers. For example, one or more pockets or compartments may be provided for removably introducing coupons, photographic film strips, negatives or individual frames thereof, prints, or, alternatively, one or more sheets of paper, paperboard or the like having pictures and/or other memorabilia mounted thereon.

In structural design, the pockets or compartments of these prior art sheet protectors are generally formed along a series of parallel spaced sealing lines and perpendicular spaced sealing lines thereby defining rectangular pockets or compartments between the three sealing lines which have a dimension somewhat greater than the height and length of a photographic film strip. Similarly, an open end or slit may be formed that extends across the top of each pocket or compartment substantially the entire length thereof to provide a means for removably introducing one or more photographic items.

In addition, sheet protectors of the prior art were developed which incorporate a pair of complimentary tabs laterally extending from corresponding edges of the respective upper and lower layers of the sheet protector. Accordingly, the tabs may be sequentially indexed with respect to each other in order to provide a set of position selectable sheet protectors that can be selectively disposed within a loose-leaf binder or scrapbook. Another example of sheet protectors of the prior art includes a spacer frame having a backing sheet with outer edges being coterminous with those of the spacer frame to define a mat window of a display frame wherein a picture, certificate, and/or other memorabilia may be introduced or mounted. The display frame of this prior art sheet protector generally includes one or more openings which selectively engage at least one retaining member of a loose-leaf binder when selectively introduced in relation therewith.

Another example of prior art sheet protectors includes transparent plastic folders comprising an upper opening formed between a top sheet and a bottom sheet, a binding part formed between a first sealed edge disposed parallel and in spaced-apart relation to a second sealed edge, and a third sealed edge disposed perpendicular to the first and second sealed edges and formed along the lower side of the top and bottom sheets of the transparent plastic folder. A dotted or pressed line may be provided in parallel with the second sealed edge to assist in folding the transparent plastic folder. A substantial disadvantage with prior art transparency folders, however, is its general inability to structurally retain insertable contents (e.g., a sheet of paper, paperboard, or the like having pictures and/or other memorabilia mounted thereon or, in the alternative, coupons, plies of photographic film, negatives, prints, and so forth) within the receiving pocket which includes only two sealed sides, thus allowing the insertable contents to easily escape therefrom.

In an attempt to conform the shape and/or configuration of sheet protectors for reproduction by means of a printing device, those skilled in the art developed a one-piece divider assembly comprising a divider sheet having a binding edge which may be folded over along one edge for the purpose of feeding the sheet into a conventional printer for the purpose of image or text reproduction. More specifically, the prior art divider assembly includes a binding edge region having a folding portion which has spaced ring apertures for selectively engaging one or more retaining members of a loose-leaf binder and a non-folding portion which is separated by a folding line about which the folding portion may fold. In structural design, the binding edge region is generally formed having a reduced thickness such that when the folding portion is folded over and adhesively tacked down over the non-folding portion, the total thickness of both the folding and non-folding portions is approximately the same as the general thickness of the main body of the sheet of the binder assembly.

One disadvantage of divider assemblies of the prior art is the cost associated with the multiplicity of working parts. As will be appreciated in the art, economic considerations of this nature are significant when dealing with this highly competitive industry, since relatively complicated sheet protectors are frequently found to be commercially impractical. Accordingly, even a slight savings in cost may substantially enhance the commercial appeal of a particular component or assembly when considering issues of mass production of the product.

Another significant disadvantage with sheet protectors of the prior art as generally described above is the difficultly in turning or manipulating the contents (e.g., a sheet of paper, paperboard, or the like having pictures and/or other memorabilia displayed thereon or, in the alternative, coupons, plies of photographic film, negatives, prints, and so forth) selectively introduced into one or more receiving pockets or compartments of the sheet protector, thus making it cumbersome and sometimes difficult to flex or bend an insertable sheet without inadvertently bending the contents and causing damage thereto.

Some prior art sheet protectors also suffer from excessive bending when placed in a binder. This situation may commonly occur with sheet protectors tightly packed into a binder having extendable rods. When this binder is opened such that the front and back covers are fully open to form a common plane, the sheet protectors will be substantially bent near the openings in the protectors. This occurs because the protector portion adjacent the holes is substantially perpendicular with the rods, whereas the protector portion on the edge opposite the holes is substantially parallel with the rods. Thus, the protector will bend and flex, mostly near the holes. Accordingly, the contents inside of the protectors will also bend.

Because of this bending and flexing of the protectors near the holes, many sheet protectors are difficult to turn. Moreover, the bending of the material inside the protector can be exacerbated when the protector page is turned, which can result in further damage to the material. In addition, certain fixed materials may make the page harder to turn.

Consistent with the foregoing, while prior art sheet protectors may appear generally suitable for their intended purpose, they nevertheless leave much to be desired from the standpoint of providing protection against the damage caused by the bending of the insertable contents. In this regard, the present invention provides a sheet protector having a flexible pocket which provides a means for flexing along the dimensional length of the pocket rather than inadvertently bending the contents of the sheet protector and causing damage thereto. Thus, the present invention overcomes several deficiencies of prior art sheet protectors and resolves several problems left unsolved by the known prior art.

BRIEF SUMMARY AND OBJECTS OF THE INVENTION

In view of the foregoing, it is a primary object of the present invention to provide a novel flexible sheet protector.

It is also an object of the present invention to provide a flexible protective sheet comprising a flexible pocket operably disposed between a retaining or receiving pocket and a securement portion, the flexible pocket being inherently conformable to provide a means for flexing or bending the flexible protective sheet along its dimensional length to inadvertently avoid bending the internal contents of the retaining or receiving pocket upon manipulation.

Another object of the present invention is to enable sheet protectors to lay flat when placed in a binder and to facilitate the turning of the sheet protectors without undue binding.

It is a further object of the present invention to provide a flexible sheet protector having simplicity of construction and effectiveness of operation.

Similarly, it is an object of the present invention to provide a flexible sheet protector which is user-friendly and inherently content protective.

In addition, it is an object of the present invention to provide a flexible sheet protector which provides universal application for various applications.

Consistent with the foregoing objects, and in accordance with the invention as embodied and broadly described herein, a flexible sheet protector is disclosed in one presently preferred embodiment of the present invention as including a first transparent sheet and a second transparent sheet having at least one retaining pocket formed therebetween. Preferably, the retaining pocket comprises an internal periphery having a dimensional height which substantially extends between an opening formed at an upper end of the second sheet and a closed end of the flexible sheet protector disposed opposite thereto. Formed in spaced-apart relation to the retaining pocket of the flexible sheet protector is a securement portion comprising at least one through-bore having an internal periphery which is dimensionally sufficient for engaging one or more retaining members of a loose-leaf binder. Operably formed between the retaining pocket and the securement portion of the flexible sheet protector is a flexible pocket. Structurally, the flexible pocket preferably comprises an elongated body having at least two opposing sealed sides, an opening disposed adjacent the opening of the retaining pocket, and a sealed end preferably formed contiguous the closed end of the flexible sheet protector.

In one presently preferred method or use of the present invention, a sheet of paper, paperboard, or the like which may comprise one or more pictures and/or other memorabilia mounted thereon or displayed in relation thereto is selectively introduced through the opening formed at the upper end of the second sheet and retained within the internal periphery of the retaining pocket of the flexible sheet protector. Correspondingly, the structural disposition of the flexible pocket in relation to the retaining pocket and the securement portion of the flexible sheet protector provides a novel means for flexing or bending the sheet protector along the dimensional length of the elongated body of the flexible pocket, rather than inadvertently bending the contents of the retaining pocket upon manipulation of the flexible sheet protector of the present invention. Also in accordance with the present invention as embodied and broadly described herein, in another presently preferred embodiment of the present invention, the present invention may be considered to be a protective cover comprising a receiving portion which is configured so as to be capable of selectively receiving contents; a securement portion which is configured so as to be capable of being secured in a storage device, such as a binder; and a flexible portion positioned between the receiving portion and the securement portion, the flexible portion being configured so as to be capable of flexing, thereby reducing flexing of the receiving portion. Preferably, the flexible portion of such a protective cover contains substantially no contents, and is preferably configured so as to contain substantially no contents and/or so as to be capable of containing substantially no contents. Furthermore, in such embodiment, the flexible portion preferably has a substantially smaller dimensional width than the dimensional width of the receiving portion, and in one very specific and preferred embodiment, the flexible portion has a width of about ½ inch. Also in this presently preferred embodiment, the securement portion preferably comprises a through-bore, wherein the flexible portion is positioned proximate to the through-bore, and more preferably, the securement portion comprises three through-bores positioned in spaced-apart relationship along the securement portion. Further in this presently preferred embodiment, the protective cover is preferably formed of a transparent material, and the flexible portion of the protective cover preferably comprises two seal lines, one of the seal lines forming a border between the securement portion and the flexible portion, and the other of the seal lines forming a border between the receiving portion and the flexible portion. As will be appreciated, the protective cover of this preferred embodiment may include contents within the receiving portion, for example, the contents comprising a sheet of paper having memorabilia displayed thereon. Further as will be appreciated, the protective cover and contents carried therein may be secured within a binder having a front cover, a back cover, a spine positioned between the front and back covers, and a retaining member which is capable of engaging the securement portion of the protective cover. Clearly, all other features of the present invention described herein as a flexible sheet protector also apply to this preferred embodiment of the present invention described as a protective cover.

Further in accordance with the present invention as embodied and broadly described herein, in another presently preferred embodiment thereof, the present invention may be considered to be a flexible sheet comprising a sheet portion; a securement portion which is configured so as to be capable of being secured in a storage device; and a flexible portion positioned between the sheet portion and the securement portion, the flexible portion being configured so as to be capable of flexing, thereby reducing flexing of the sheet portion. Clearly, the features disclosed herein with regard to the present invention described as a flexible sheet protector or as a protective cover also apply to this embodiment of the present invention described as a flexible sheet.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 and 2, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
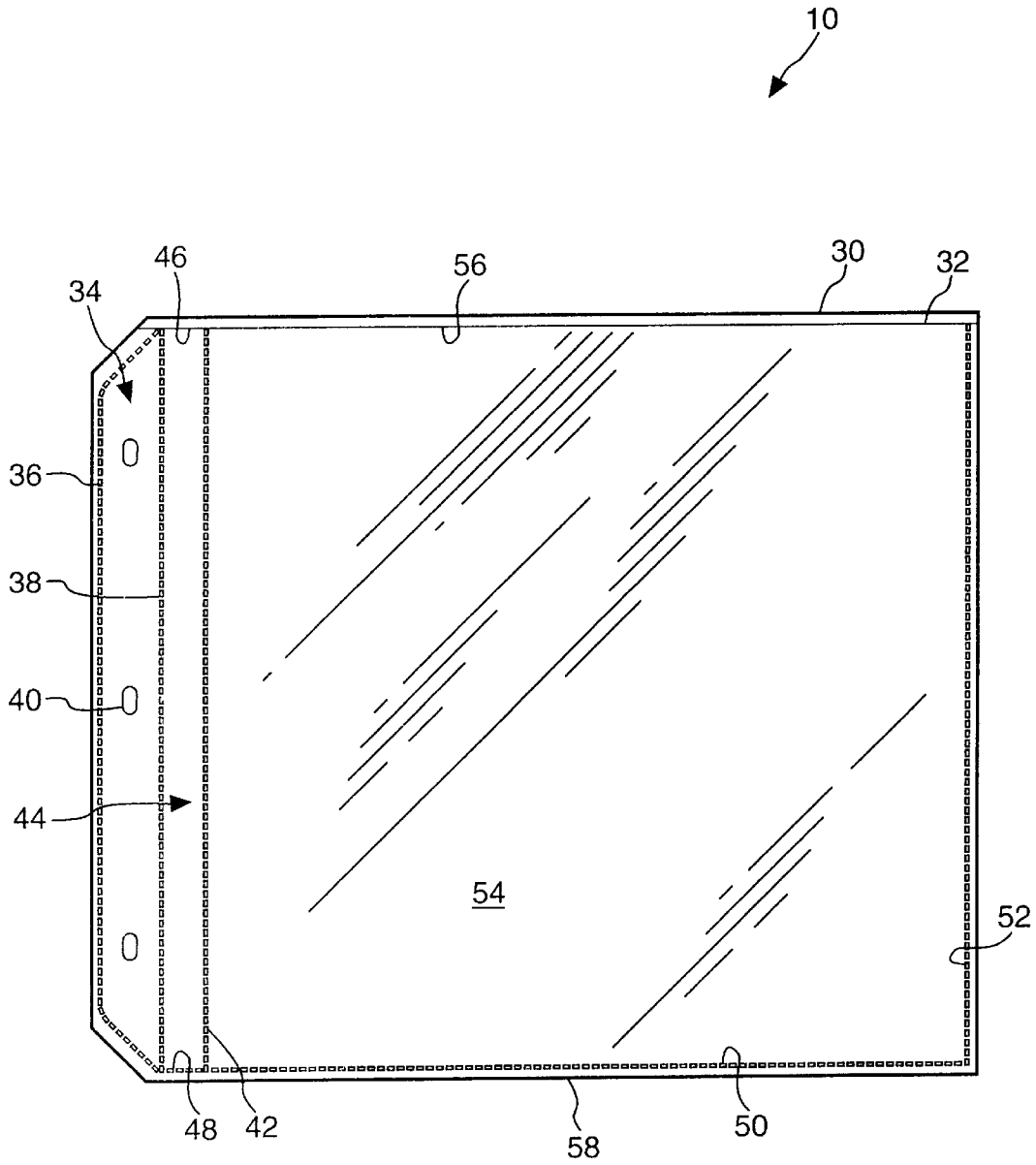
FIG. 1 is a front elevational view of a flexible sheet protector in accordance with one presently preferred embodiment of the present invention.
Figure 2:
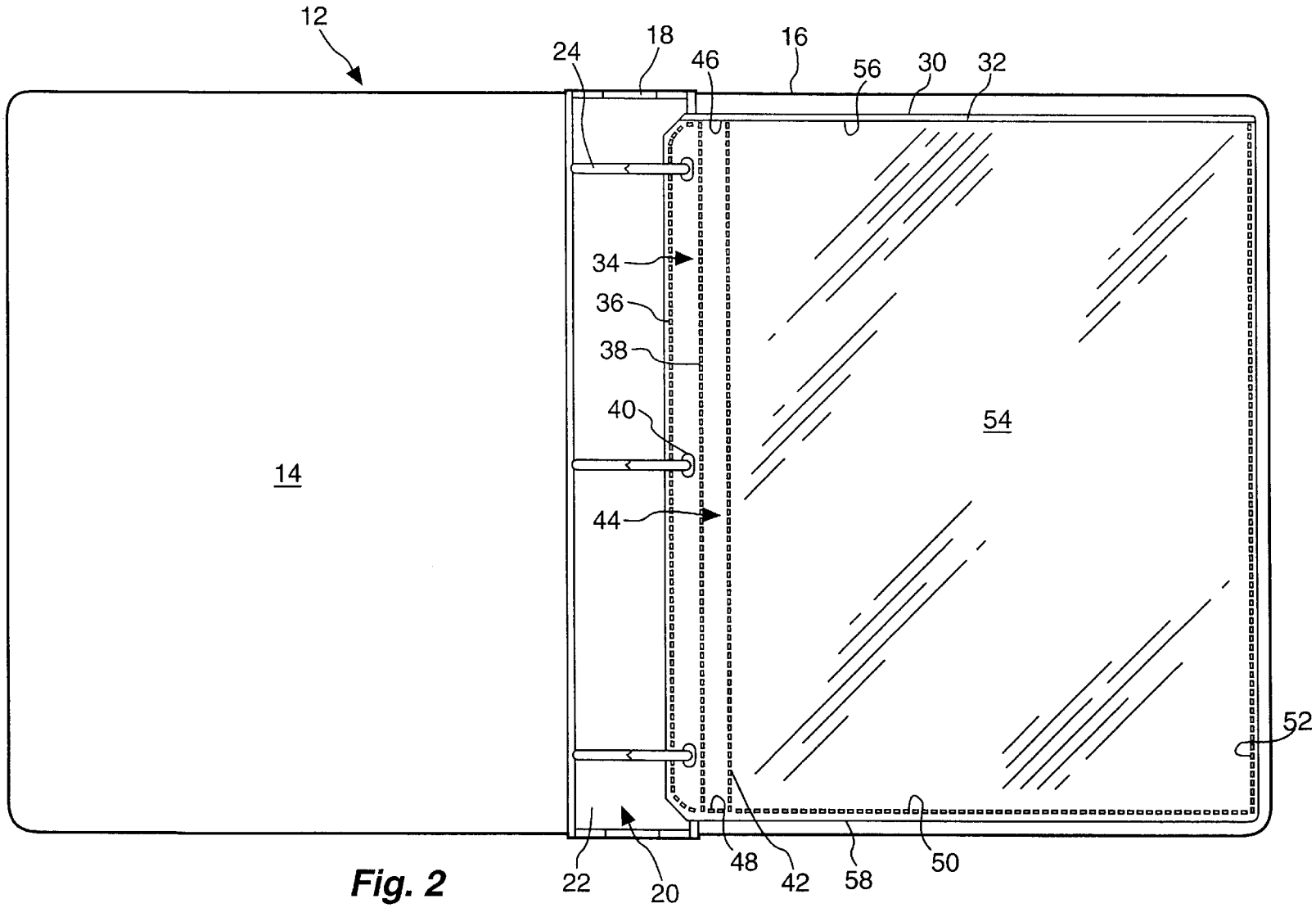
FIG. 2 is a front elevational view of one presently preferred embodiment of the flexible sheet protector operably disposed in relation to a loose-leaf binder in accordance with the presently preferred embodiment of the present invention as illustrated in FIG. 1.

One presently preferred embodiment of the present invention, designated generally at 10, is best illustrated in FIGS. 1 and 2. As shown, a flexible sheet protector 10 includes a first sheet 30 and a second sheet 32 having at least one retaining pocket 54 (also sometimes referred to herein as a "receiving pocket") formed therebetween. In one presently preferred embodiment of the present invention, the retaining pocket 54 comprises a dimensional height which preferably extends between an opening 56 formed at an upper end of the second sheet 32 and a closed end 58 of the flexible sheet protector 10 disposed opposite thereto. Formed in spaced-apart relation to the retaining pocket 54 of the flexible sheet protector 10 is a securement portion 34 comprising at least one through-bore 40 having an internal periphery being dimensionally sufficient for engaging one or more retaining members 24 of a loose-leaf binder 12, as best illustrated in FIG. 2.

Operably disposed between the retaining pocket 54 and the securement portion 34 of the flexible sheet protector 10 is a flexible pocket or portion 44 having an elongated configuration comprising at least two opposing sealed sides 38, 42, an opening 46 formed adjacent the opening 56 of the retaining pocket 54 formed at the upper end of the second sheet 32, and a sealed end 48 disposed contiguous the closed end 58 of the flexible sheet protector 10. As seen in FIGS. 1 and 2, flexible pocket or portion 44 is positioned proximate to each of through-bores 40. Correspondingly, the structural disposition of the flexible pocket 44 in relation to the retaining pocket 54 and the securement portion 34 of the flexible sheet protector 10 provides a means for flexing or bending the sheet protector along the dimensional length of the elongated body of the flexible pocket 44, rather than inadvertently bending the contents of the retaining pocket 54 upon manipulation of the flexible sheet protector 10 of the present invention.

The flexible pocket 44 enables the sheet protector 10 to lay nearly flat when the protector 10 is residing in an open binder 12 because the protector 10 may bend along the flexible pocket 44 thereby reducing the amount of bending that occurs in the retaining pocket 54. Moreover, the flexible pocket 44 facilitates easier turning of the protectors 10 by the bending of the flexible pocket 44 and because of the added area to the protector 10 because of the flexible pocket 44. In addition, the bending of the protector's contents when the protector 10 is turned is greatly reduced because the flexible pocket 44 may bend thereby allowing the retaining pocket 54 to lay substantially flat.

Figure 3:
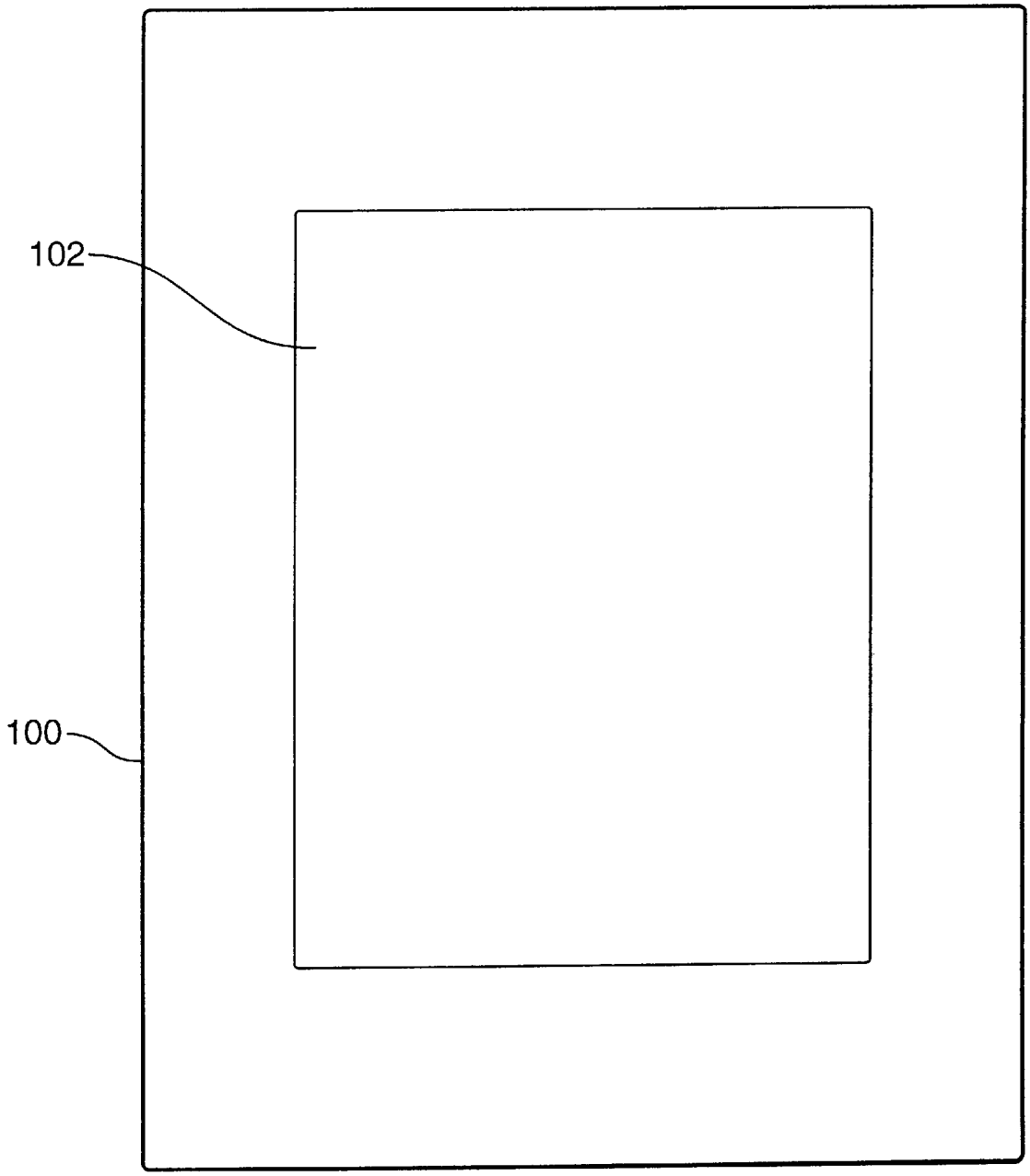
FIG. 3 is a front elevational view of a sheet of paper having memorabilia thereon which may be inserted into a flexible sheet protector within the scope of the present invention.

The first and second sheets 30, 32 of the flexible sheet protector 10 are preferably formed of a transparent material which is sufficiently sturdy so as to provide a means for protecting the contents selectively introduced into the internal periphery of the retaining pocket 54. As used herein, the term "contents" may include, but is not intended to be limited to, plies of photographic film, negatives, prints, postcards, coupons, certificates, awards, one or more leafs or sheets of paper, paperboard, or the like which may comprise one or more pictures and/or other memorabilia mounted thereon or displayed in relation thereto, and/or any other suitable keepsakes or mementos as will be appreciated in the art. For purposes of general illustration only, FIG. 3 shows a sheet of paper 100 upon which memorabilia designated 102 is mounted. Such sheet of paper 100 and memorabilia 102 may be inserted into flexible sheet protector 10 to protect the same.

Whereas retaining or receiving pocket 54 is specifically designed to hold contents such as memorabilia as explained herein, as seen in FIGS. 1 and 2, flexible pocket or portion 44 contains substantially no contents. In this regard, flexible pocket 44 is configured so as to contain and so as to be capable of containing substantially no contents. Further, in this regard, as again seen in FIGS. 1 and 2, flexible pocket 44 has a substantially smaller dimensional width than the dimensional width of retaining pocket 54 (the width of flexible pocket 44 and the width of retaining pocket 54 being taken in the horizontal direction in FIGS. 1 and 2). The transparent material comprising the first and second sheets 30, 32 may be formed of any of numerous organic, synthetic, or processed materials which are well known in the art. As contemplated herein, the first sheet 30 and/or the second sheet 32 of the flexible sheet protector 10 may be formed of a substantially sturdy material that is not inherently transparent but rather opaque, if desired.

Since the first and second sheets 30, 32 of the flexible sheet protector 10 of the present invention will generally conform to the size, shape, and/or configuration of a loose-leaf binder 12 to which it is to be selectively introduced and retained, it is anticipated that the various structural features thereof may be formed in a series of different sizes, shapes, and/or configurations so as to accommodate different binders. For example, the size and dimension of one presently preferred embodiment of the present invention may include a flexible sheet protector 10 having a dimensional size slightly larger than eight and one-half inches by eleven inches (8½"×11") Similarly, the flexible sheet protector 10 may be formed having, but is not intended to be limited to, a dimensional size that is slightly larger than three and three-fourth inches by six and three-fourth inches (3¾"×6¾"), five and one-half inches by eight and one-half inches (5½"×8½"), legal size (8½"×14"), twelve inches by twelve inches (12"×12"), and so forth. As will be appreciated, the first and second sheets 30, 32 of the flexible sheet protector 10 may be formed having a dimensional size which is slightly larger than standardized paper sizes known in the art so as to provide a retaining pocket 54 which provides a means for selectively introducing and retaining one or more sheets of paper, paperboard, or the like that may include one or more pictures and/or other memorabilia mounted thereon or displayed in relation thereto.

Although one presently preferred embodiment of the flexible sheet protector 10 of the present invention is illustrated and described in connection with a generally rectangular shape, those skilled in the art will readily recognize that various other geometrical configurations are likewise suitable. The use of a generally rectangular configuration is thus by way of illustration only and not by way of limitation.

As illustrated in FIGS. 1 and 2, in one presently preferred embodiment of the present invention, the dimensional height of the second sheet 32 is formed slightly smaller than the dimensional height of the first sheet 30 to form an opening 56 at an upper end of the second sheet 32 of the flexible sheet protector 10 for selectively introducing and retaining contents disposed within the internal periphery of the retaining pocket 54. It will be appreciated by those skilled in the art, however, that other dimensional sizes of the first and second sheets 30, 32, respectively, are possible.

As best illustrated in FIG. 1, the internal periphery of the retaining pocket 54 is preferably defined by a first seal line 50, a second seal line 52, and a third seal line 42. Disposed substantially parallel to the opening 56 of the retaining pocket 54 formed at the upper end of the second sheet 32, the first seal line 50 is disposed contiguous the closed end 58 of the flexible sheet protector 10. In structural relation thereto, the second seal line 52 of the retaining pocket 54 may be formed substantially parallel and in spaced-apart relation to the third seal line 42. The second and third seal lines 52, 42 are preferably disposed substantially perpendicular to the first seal line 50 thus providing the retaining pocket 54 with two opposing sealed sides 52, 42 and an opening 56 formed opposite the first seal line 50 disposed contiguous the sealed end 58 of the flexible sheet protector 10.

An alternate embodiment of the flexible sheet protector 10 of the present invention may comprise two or more receiving pockets adapted in various dimensional sizes, shapes, and/or configurations to be utilized for selectively introducing and retaining business cards, computer diskettes, credit cards, calculators, and/or various other useful articles. Structurally, each retaining pocket is preferably formed having at least two opposing sealed sides and an opening disposed opposite a sealed bottom.

Disposed in spaced-apart relation to the retaining pocket 54 of the flexible sheet protector 10 is a securement portion 34. The securement portion 34 may be formed between a fourth seal line 36 and a fifth seal line 38. Preferably, the fourth seal line 36 of the securement portion 34 is generally disposed substantially parallel to the disposition of the fifth seal line 38. In relation to the retaining pocket 54 of one presently preferred embodiment of the present invention, the fourth and fifth seal lines 36, 38 of the securement portion 34 may be formed substantially parallel the second and third seal lines 52, 42 of the retaining pocket 54.

As best shown in FIG. 1, the fourth seal line 36 may be formed comprising an angular bend at its opposing ends which generally corresponds to the specific curvilinear shape and/or configuration of the contiguous portion of the first and second sheets 30, 32 of the flexible sheet protector 10. In this regard, the opposing ends of the fourth seal line 36 may be formed so as to operably engage the opposing ends of the fifth seal line 38, respectively, thereby providing the securement portion 34 with a sealed internal chamber. It will be readily appreciated by those skilled in the art, however, that other shapes and/or configurations of the fourth seal line 36 are possible.

The securement portion 34 of the flexible sheet protector 10 comprises at least one through-bore 40 having an internal periphery being dimensionally sufficient for engaging one or more retaining members 24 of a loose-leaf binder 12. In one presently preferred embodiment of the present invention, the securement portion 34 of the flexible sheet protector 10 comprises three through-bores 40 disposed in a spaced-apart relationship along the linear length of the securement portion 34 between the fourth and fifth seal lines 36, 38.

As best illustrated in FIG. 2, a loose-leaf binder 12 is generally formed having a front cover 14, a back cover 16, a spine 18 disposed between the front and back covers 14, 16, and a retaining assembly 20 comprising one or more retaining members 24 operably disposed in relation to the spine 18 of the binder 12 by means of a fixation member 22. Structurally, the retaining members 24 of the binder 12 provide a means for engaging one or more through-bores 40 formed in relation to the securement portion 34 of the flexible protective sheet 10.

Because of the numerous retaining member configurations and the standardization of binder sizes with regards to the number and placement of one or more retaining members 24 as known in the art, it is contemplated that other configurations of one or more through-bores 40 formed in the securement portion 34 of the flexible sheet protector 10 may be constructed in accordance with the inventive principles set forth herein. It is intended, therefore, that the example provided herein be viewed as exemplary of the principles of the present invention, and not as restrictive to a particular structure and/or configuration for implementing those principles.

Operably disposed between the securement portion 34 and the retaining pocket 54 of the flexible sheet protector 10 is a flexible pocket 44. Structurally, the flexible pocket 44 may comprise an elongated configuration having two opposing sides defined by the third and fifth seal lines 42, 38, an opening 46 disposed adjacent the opening 56 at the upper end of the second sheet 32 of the flexible sheet protector 10, and a closed end or sixth seal line 48 disposed contiguous the first seal line 50 of the retaining pocket 54, as illustrated in FIG. 1.

In one presently preferred embodiment of the present invention, the flexible pocket 44 may be formed having a dimensional width of approximately one-half an inch (½") extending between the third and fifth seal lines 42, 38 and a dimensional length that corresponds to the dimensional height of the second sheet 32 of the sheet protector 10. It will be readily appreciated, however, that other sizes, shapes, and/or configurations of the flexible pocket 44 are possible which are consistent with the spirit and scope of the present invention. For example, one or more flexible pockets may be disposed between the securement portion 34 and one or more retaining pockets 54 of the flexible sheet protector 10, if desired. Moreover, a rigid member may be disposed within the internal periphery of one or more of the flexible pockets 44 so as to provide rigidity upon manipulation of the flexible sheet protector 10 of the present invention. It is intended, therefore, that the example provided herein be viewed as exemplary of the principles of the present invention, and not as restrictive to a particular structure for implementing those principles.

Preferably, the first, second, third, fourth, and fifth seal lines 50, 52, 42, 38, 36 of the flexible sheet protector 10 are formed by conventional heat sealing methods readily known in the art. As will be appreciated, additional seal lines may be provided in the body of the flexible sheet protector of the present invention so as to form two or more retaining pockets 54 or flexible pockets 44 which may also be formed by conventional heat sealing methods.

From the above discussion, it will be appreciated that the present invention provides a novel flexible sheet protector. Unlike prior art sheet protectors, the present invention provides a flexible sheet protector comprising a flexible pocket inherently conformable along its dimensional length to provide a means for flexing or bending the flexible protective sheet to inadvertently avoid bending the contents of the retaining pocket upon manipulation.

Consistent with the foregoing, the present invention provides a flexible sheet protector having simplicity of construction, effectiveness of operation, and being functional as to universal application. The present invention also provides a sheet protector that will lay nearly flat when the binder in which it is placed is open.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A protective cover, comprising:

a receiving portion which is configured so as to be capable of selectively receiving contents;

a securement portion which is configured so as to be capable of being secured in a storage device; and a flexible portion positioned between said receiving portion and said securement portion, said flexible portion being configured so as to be capable of flexing, thereby reducing flexing of said receiving portion.

2. A protective cover as defined in claim 1 wherein said flexible portion has a substantially smaller dimensional width than a dimensional width of said receiving portion.

3. A protective cover as defined in claim 1 wherein said flexible portion has a width of about ½ inch.

4. A protective cover as defined in claim 1 wherein said securement portion comprises a through-bore and wherein said flexible portion is positioned proximate to said through-bore.

5. A protective cover as defined in claim 1 wherein said flexible portion contains substantially no contents.

6. A protective cover as defined in claim 1 wherein said flexible portion is configured so as to contain substantially no contents.

7. A protective cover as defined in claim 1 wherein said flexible portion is configured so as to be capable of containing substantially no contents.

8. A protective cover as defined in claim 1 wherein said flexible portion comprises two seal lines, one of said seal lines forming a border between said securement portion and said flexible portion and the other of said seal lines forming a border between said receiving portion and said flexible portion.

9. A protective cover as defined in claim 1 wherein said protective cover is formed of a transparent material.

10. A protective cover as defined in claim 1 further comprising contents within said receiving portion, said contents comprising a sheet of paper having memorabilia displayed thereon.

11. A protective cover as defined in claim 1 wherein said securement portion comprises three through-bores positioned in spaced-apart relationship along said securement portion.

12. A protective cover as defined in claim 1 further comprising a binder having a front cover, a back cover, a spine positioned between said front and back covers, and a retaining member which is capable of engaging said securement portion of said protective cover.

13. A flexible sheet, comprising:

a sheet portion;

a securement portion which is configured so as to be capable of being secured in a storage device; and a flexible portion positioned between said sheet portion and said securement portion, said flexible portion being configured so as to be capable of flexing, thereby reducing flexing of said sheet portion.

14. A flexible sheet as defined in claim 13 wherein said flexible portion has a substantially smaller dimensional width than a dimensional width of said sheet portion.

15. A flexible sheet as defined in claim 13 wherein said flexible portion has a width of about ½ inch.

16. A flexible sheet as defined in claim 13 wherein said securement portion comprises a through-bore and wherein said flexible portion is positioned proximate to said through-bore.

17. A flexible sheet as defined in claim 13 wherein said flexible portion comprises two seal lines, one of said seal lines forming a border between said securement portion and said flexible portion and the other of said seal lines forming a border between said sheet portion and said flexible portion.

18. A flexible sheet as defined in claim 13 wherein said flexible sheet is formed of a transparent material.

19. A flexible sheet as defined in claim 13 wherein said securement portion comprises three through-bores positioned in spaced-apart relationship along said securement portion.

20. A flexible sheet as defined in claim 13 further comprising a binder having a front cover, a back cover, a spine positioned between said front and back covers, and a retaining member which is capable of engaging said securement portion of said flexible sheet.

* * * * *